US011577122B2

(12) United States Patent
Hsu

(10) Patent No.: US 11,577,122 B2
(45) Date of Patent: Feb. 14, 2023

(54) LIMBS COOPERATION EXERCISER AND CONTROL METHOD FOR THE SAME

(71) Applicant: GEE HOO FITEC CORP., New Taipei (TW)

(72) Inventor: Ching-Lu Hsu, Taipei (TW)

(73) Assignee: GEE HOO FITEC CORP., New Taipei (TW)

( * ) Notice: Subject to any disclaimer, the term of this patent is extended or adjusted under 35 U.S.C. 154(b) by 69 days.

(21) Appl. No.: 17/152,067

(22) Filed: Jan. 19, 2021

(65) Prior Publication Data

US 2022/0226692 A1 Jul. 21, 2022

(51) Int. Cl.

| | |
|---|---|
| ***A63B 22/06*** | (2006.01) |
| ***A63B 22/00*** | (2006.01) |
| ***A63B 21/00*** | (2006.01) |
| ***A63B 24/00*** | (2006.01) |

(52) U.S. Cl.

CPC .... *A63B 22/0605* (2013.01); *A63B 21/00181* (2013.01); *A63B 22/0007* (2013.01); *A63B 22/0012* (2013.01); *A63B 24/0087* (2013.01)

(58) Field of Classification Search

CPC . A63B 22/06; A63B 22/0605; A63B 22/0007; A63B 2022/0658; A63B 21/00181; A63B 2024/0093; A63B 24/0087; A63B 22/0012; A63B 22/001; A61H 1/0214

See application file for complete search history.

(56) References Cited

U.S. PATENT DOCUMENTS

| | | | | |
|---|---|---|---|---|
| 3,991,749 A * | 11/1976 | Zent | A63B 22/0005 601/36 |
| 4,436,097 A * | 3/1984 | Cunningham | A63B 22/0005 482/62 |
| 8,409,060 B2 * | 4/2013 | Hsu | A63B 21/4041 482/57 |
| 2018/0228682 A1 * | 8/2018 | Bayerlein | A63B 21/00181 |

FOREIGN PATENT DOCUMENTS

DE 102004020006 A1 * 11/2005 ..... A61H 1/0214

OTHER PUBLICATIONS

"TLE4966V-1K", Infineon, Sep. 23, 2013, p. 5, accessed from https://www.electronicspecifier.com/attachment/view/52b1d018e34e247b09ea1154/Infineon-Hall_Switches_TLE4966V-TPD-v1 (Year: 2013).*

* cited by examiner

*Primary Examiner* — Erin Deery
*Assistant Examiner* — Peter H Forstner
(74) *Attorney, Agent, or Firm* — Apex Juris, PLLC; Hilde Coeckx; Tracy Heims

(57) ABSTRACT

A limbs cooperation exerciser and a control method for the same are provided. The limbs cooperation exerciser includes a frame, an upper limb exercise mechanism, a first driving module, a lower limb exercise mechanism, a second driving module, a first rotating speed sensor, a second rotating speed sensor, and a control module. The control module controls at least one of the first driving module and the second driving module according to the first rotating speed and the second rotating speed, making a differential value between the detected first rotating speed and the second rotating speed be smaller than or equal to a predetermined differential value. That is, the limbs cooperation exerciser controls the rotation of the first operating member or the second operating member to lower the difference between the rotating speeds (Continued)

of the first operating member and the second operating member.

15 Claims, 6 Drawing Sheets

LIMBS COOPERATION EXERCISER AND CONTROL METHOD FOR THE SAME

BACKGROUND OF THE INVENTION

1. Technical Field

The present invention relates generally to an exerciser, and more particularly to a limbs cooperation exerciser and a control method for the limbs cooperation exerciser, which assist arms and legs in exercising.

2. Description of Related Art

For improving the muscle strength of the upper and lower limbs, a limbs exerciser is commonly used to assist users to exercise their limbs or to perform postoperative rehabilitation. A conventional limbs exerciser usually includes a frame, a seat, handles, and pedals. After holding the handles with hands or stepping on the pedals, the user performs periodic revolving motions to stretch and exercise the upper and lower limbs, thereby achieving muscle endurance training or rehabilitation of limbs.

However, muscle endurance training or rehabilitation often need to be performed continuously for a long time, which is unavoidably tedious. Furthermore, if the user's upper or lower limbs are not strong enough to turn the handles or pedals smoothly on their own, the user would feel frustrated or discomfort during the training or rehabilitation treatment, thereby reducing the user's willingness to operate the exerciser, which leads to abandonment of training. Besides, if the upper limbs are stronger than the lower limbs, or conversely, the lower limbs are stronger than the upper limbs and thus move faster, the limbs would be incoordinate.

Therefore, the conventional limbs exerciser needs to be improved.

BRIEF SUMMARY OF THE INVENTION

In view of the above, the primary objective of the present invention is to provide a limbs cooperation exerciser and a control method for the limbs cooperation exerciser, which assists the user's weak limbs to smoothly perform muscle endurance training or rehabilitation.

The present invention provides a limbs cooperation exerciser including a frame, an upper limb exercise mechanism, a first driving module, a lower limb exercise mechanism, a second driving module, a first rotating speed sensor, a second rotating speed sensor, and a control module.

The upper limb exercise mechanism includes a first rotating member and a first operating member, wherein the first rotating member is pivotally connected to the frame; the first operating member is connected to the first rotating member, and the first operating member is driven by an external force to drive the first rotating member to rotate; the first driving module is coupled to the first rotating member and is controllable to drive the first rotating member to rotate; the lower limb exercise mechanism includes a second rotating member and a second operating member, wherein the second rotating member is pivotally connected to the frame; position of the second rotating member is lower than the first rotating member; the second operating member is connected to the second rotating member, and the second operating member is driven by an external force to drive the second rotating member to rotate; the second driving module is coupled to the second rotating member and is controllable to drive the second rotating member to rotate; the first rotating speed sensor is coupled to the upper limb exercise mechanism for detecting rotating speed of the first rotating member; the second rotating speed sensor is coupled to the lower limb exercise mechanism for detecting rotating speed of the second rotating member; the control module is electrically connected to the first driving module, the second driving module, the first rotating speed sensor, and the second rotating speed sensor; the control module obtains a first rotating speed which is detected by the first rotating speed sensor, and obtains a second rotating speed which is detected by the second rotating speed sensor; the control module controls at least one of the first driving module and the second driving module according to the first rotating speed and the second rotating speed, which makes a differential value between the first rotating speed and the second rotating speed be smaller than or equal to a predetermined differential value.

Another objective of the present invention is to provide a control method for a limbs cooperation exerciser, wherein the limbs cooperation exerciser includes an upper limb exercise mechanism, a first driving module, a lower limb exercise mechanism, a second driving module, a first rotating speed sensor, a second rotating speed sensor, and a control module. The upper limb exercise mechanism includes a first rotating member and a first operating member, wherein the first operating member is connected to the first rotating member, and the first operating member is driven by an external force to drive the first rotating member to rotate; the lower limb exercise mechanism includes a second rotating member and a second operating member, wherein the second operating member is connected to the second rotating member, and the second operating member is driven by an external force to drive the second rotating member to rotate; the first rotating speed sensor is provided for detecting rotating speed of the first rotating member, and the second rotating speed sensor is provided for detecting rotating speed of the second rotating member. The control method for a limbs cooperation exerciser is executed by the control module and includes the following steps:

detecting rotating speeds of the first rotating member and the second rotating member through the first rotating speed sensor and the second rotating member respectively so as to obtain a first rotating speed and a second rotating speed; controlling at least one of the first driving module and the second driving module according to the first rotating speed and the second rotating speed, making a differential value between the detected first rotating speed and the second rotating speed be smaller than or equal to a predetermined differential value.

The effect of the present invention is that, the control module controls at least one of the first driving module and the second driving module according to the first rotating speed and the second rotating speed, making a differential value between the detected first rotating speed and the second rotating speed be smaller than or equal to a predetermined differential value. That is, the limbs cooperation exerciser controls the rotation of the first operating member or the second operating member to lower the difference between the rotating speeds of the first operating member and the second operating member.

BRIEF DESCRIPTION OF THE SEVERAL VIEWS OF THE DRAWINGS

The present invention will be best understood by referring to the following detailed description of some illustrative embodiments in conjunction with the accompanying drawings, in which.

DETAILED DESCRIPTION OF THE INVENTION

Figure 1:
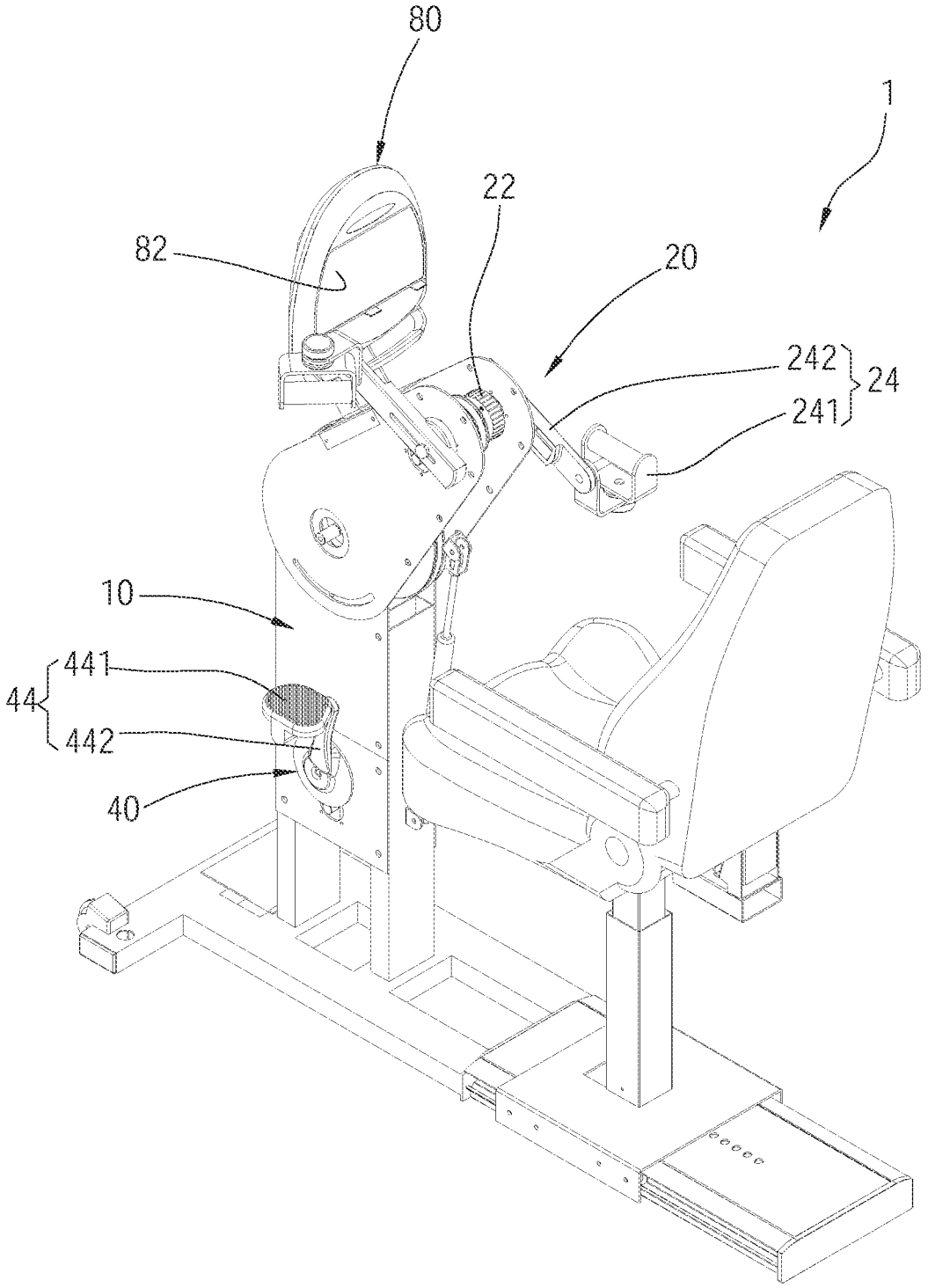
FIG. 1 is a perspective view of the limbs cooperation exerciser of the first preferred embodiment of the present invention.
Figure 2:
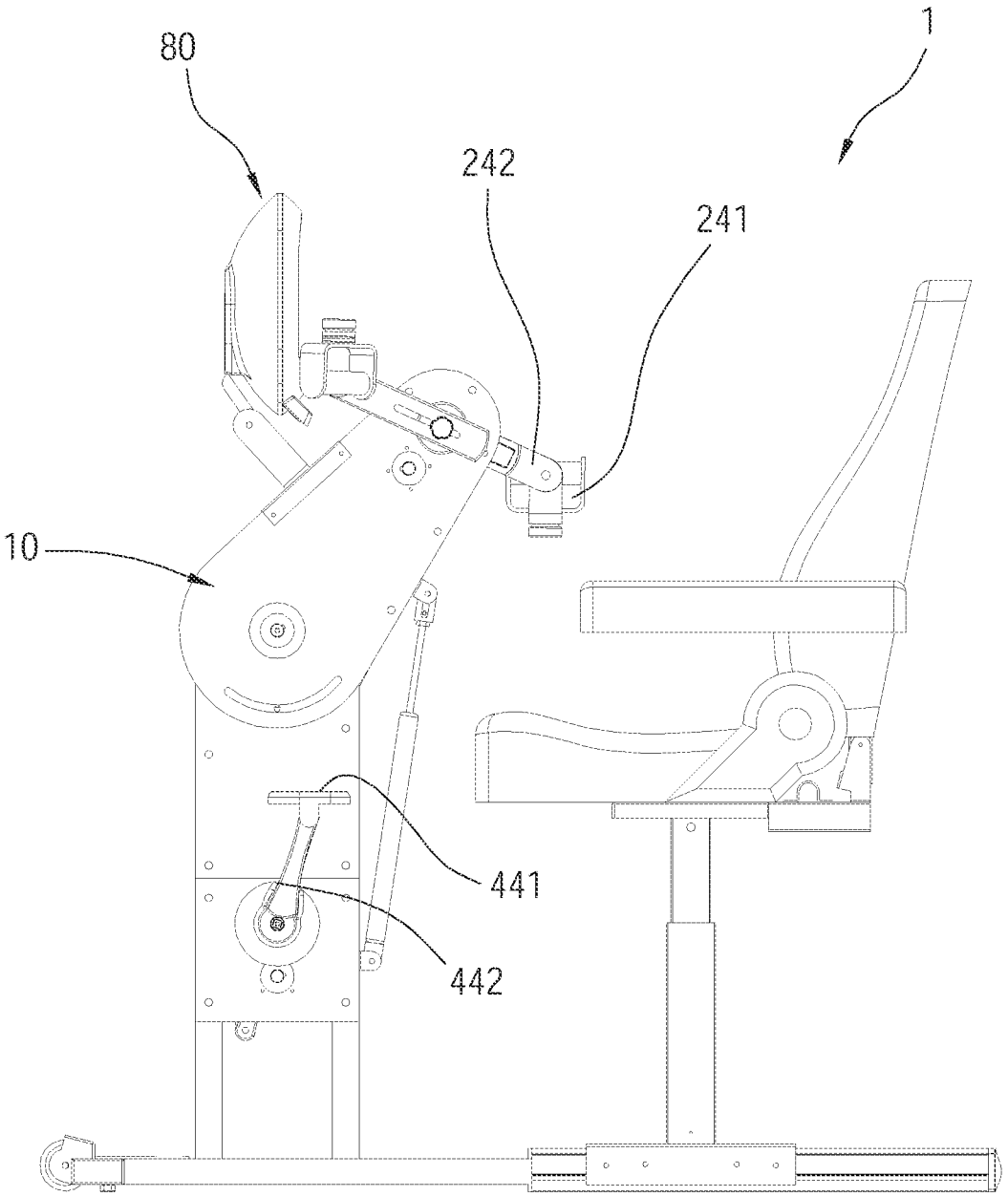
FIG. 2 is a lateral view of the limbs cooperation exerciser in FIG. 1.
Figure 3:
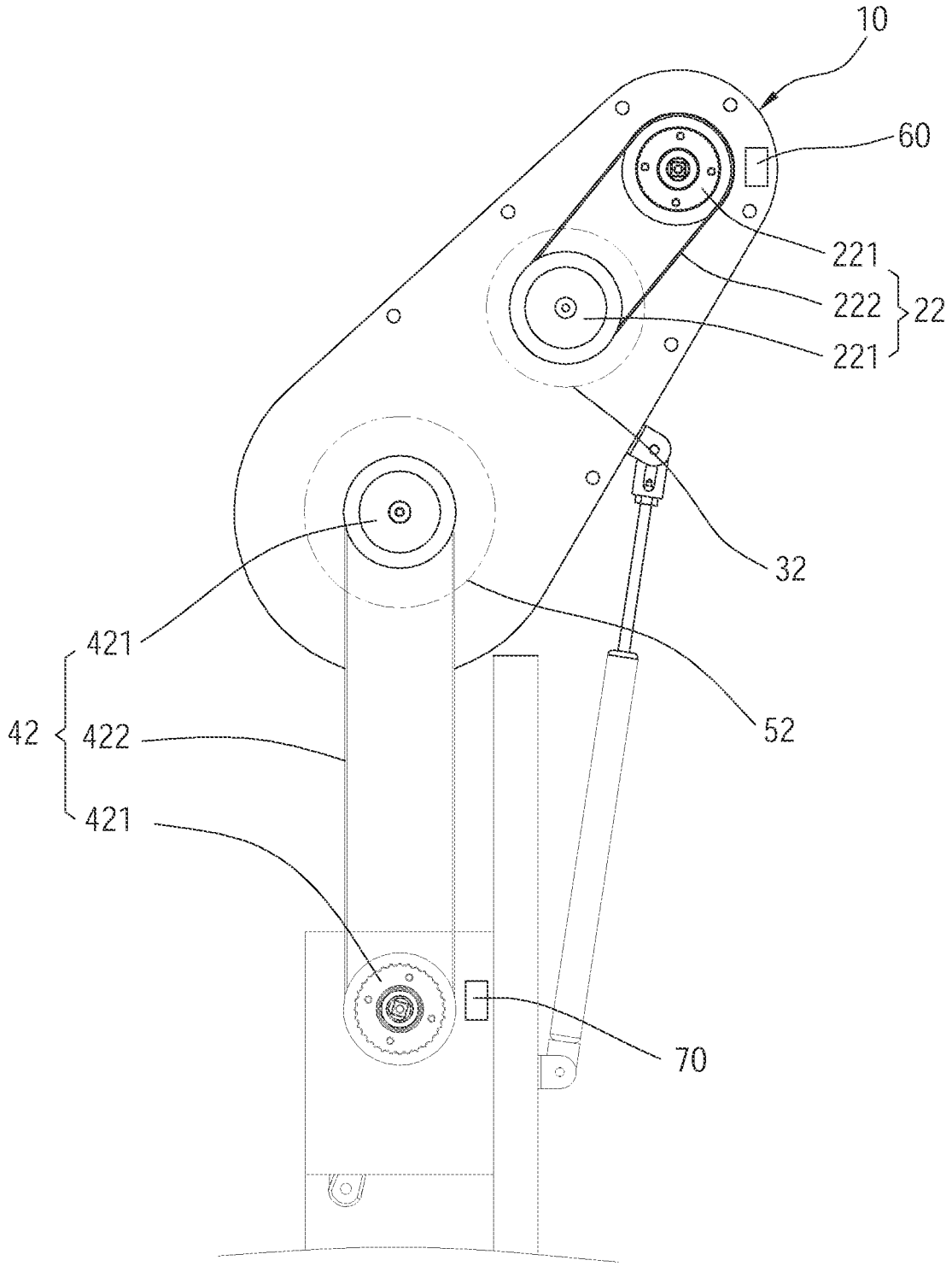
FIG. 3 is a schematic diagram of partial components in FIG. 2.
Figure 4:
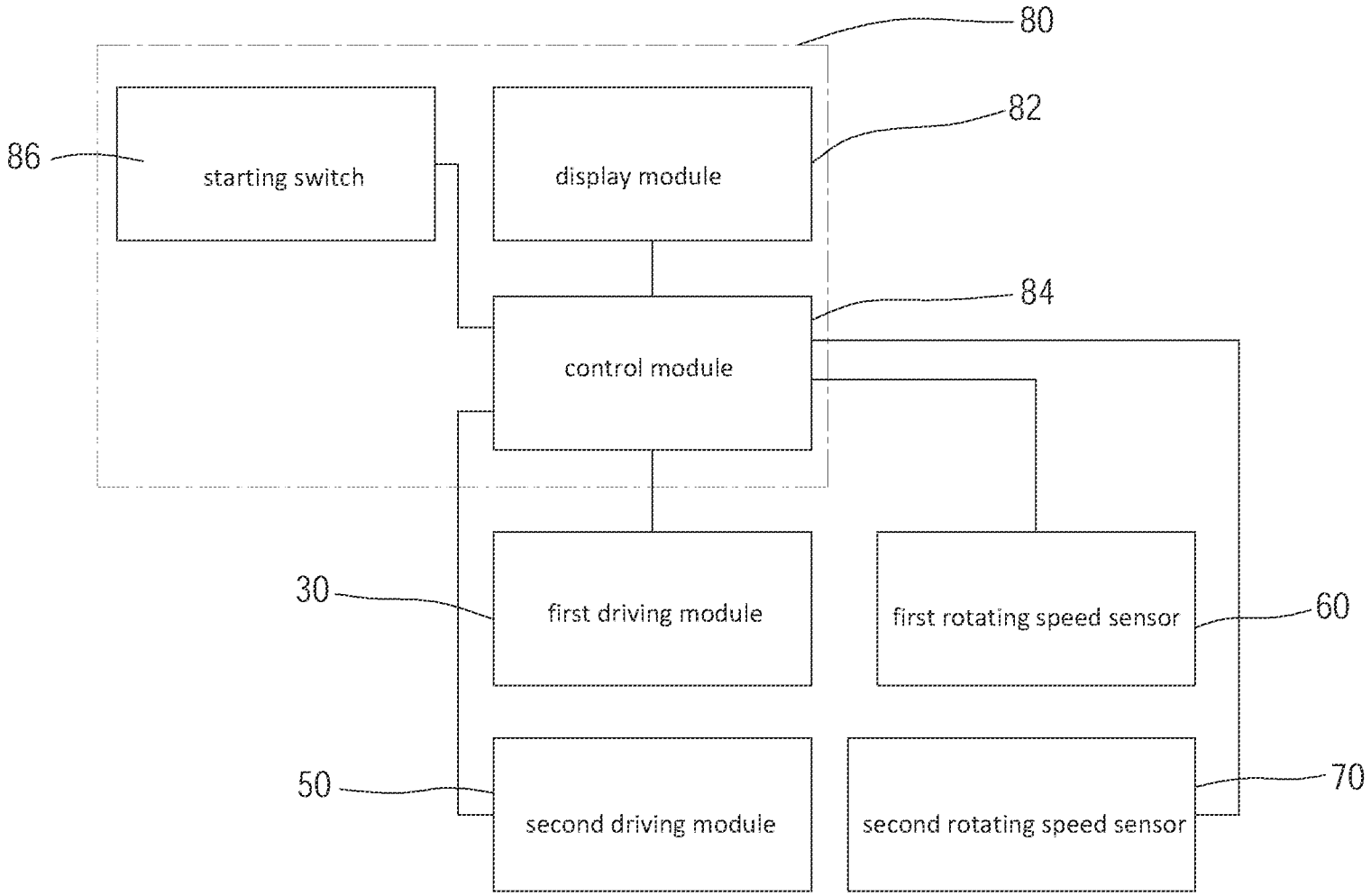
FIG. 4 is a block diagram of the limbs cooperation exerciser of the first preferred embodiment.

As shown in FIG. 1 to FIG. 4, a first embodiment of the present invention, a limbs cooperation exerciser 1, includes a frame 10, an upper limb exercise mechanism 20, a first driving module 30, a lower limb exercise mechanism 40, a second driving module 50, a first rotating speed sensor 60, a second rotating speed sensor 70, and a control panel 80.

The upper limb exercise mechanism 20 includes a first rotating member 22 and a first operating member 24. The first rotating member 22 is pivotally connected to the frame 10. The first operating member 24 is connected to the first rotating member 22, and the first operating member 24 is driven by an external force to drive the first rotating member 22 to rotate. The first driving module 30 is coupled to the first rotating member 22, and can be controlled to drive the first rotating member 22 to rotate. In this embodiment, the first rotating member 22 includes two first pulleys 221 and a first belt 222. The first operating member 24 includes two hand grips 241 and two first cranks 242. The first driving module 30 includes a first motor 32; the first belt 222 is winded around the two first pulleys 221; one of the two first pulleys 221 is connected to the first motor 32, and the two first cranks 242 are respectively connected to the left and the right sides of the other one of the two first pulleys 221, wherein each of the first cranks 242 is connected to one of the hand grips 241 for users to hold. By the abovementioned design, the user can grasp each hand grip 241 and exerts an external force thereon to drive the two first pulleys 221 and the first belt 222 to rotate. In addition, the first motor 32 can also assist in driving the first pulleys 221 and the first belt 222 to rotate, which makes each first crank 242 and each hand grip 241 rotate. Thus, by grasping each hand grip 241, the upper limbs of the user perform periodic revolving motions with the rotation of each first crank 242 and each hand grip 241.

The lower limb exercise mechanism 40 includes a second rotating member 42 and a second operating member 44. The second rotating member 42 is pivotally connected to the frame 10. The second operating member 44 is connected to the second rotating member 42, and the second operating member 44 is driven by an external force to drive the second rotating member 42 to rotate. The second driving module 50 is coupled to the second rotating member 42, and can be controlled to drive the second rotating member 42 to rotate. In this embodiment, the second rotating member 42 includes two second pulleys 421 and a second belt 422. The second operating member 44 includes two pedals 441 and two second cranks 442. The second driving module 50 includes a second motor 52; the second belt 422 is winded around the two second pulleys 421; one of the two second pulleys 421 is connected to the second motor 52, and the two second cranks 442 are respectively connected to the left and the right sides of the other one of the two second pulleys 421, wherein each of the second cranks 442 is connected to one of the pedals 441 for users to step on. By the abovementioned design, the user can step on each pedal 441 and exerts an external force thereon to drive the two second pulleys 421 and the second belt 422 to rotate. Additionally, the second motor 52 can also assist in driving the two second pulleys 421 and the second belt 422 to rotate, which makes each second crank 442 and each hand grip 241 to rotate. Thus, by stepping on each pedal 441, the lower limbs of the user perform periodic revolving motions with the rotation of each second crank 442 and each pedal 441.

Moreover, the first operating member 24 can be driven by an external force to drive the first rotating member 22 to rotate forward or backward; the second operating member 44 can be driven by an external force to drive the second rotating member 42 to rotate forward or backward. That is, the first operating member 24 and the second operating member 44 can respectively drive the first rotating member 22 and the second rotating member 42 to rotate forward or backward according to the direction of the force exerted by the user.

The first rotating speed sensor 60 is couple to the upper limb exercise mechanism 20 to detect the rotating speed of the first rotating member 22. The second rotating speed sensor 70 is couple to the lower limb exercise mechanism 40 to detect the rotating speed of the second rotating member 42. The first rotating speed sensor 60 and the second rotating speed sensor 70 can be electromagnetic rotating speed sensors, photoelectric rotating speed sensors, or other sensors which can sense rotating speed. In this embodiment, the first rotating speed sensor 60 and the second rotating speed sensor 70 are electromagnetic rotating speed sensors as examples but not limitations; they can also be Hall sensors, photoelectric switches, or proximity switches. The first rotating speed sensor 60 is set near the first rotating member 22, and the second rotating speed sensor 70 is set near the second rotating member 42, for detecting the rotating speeds of the first rotating member 22 and the second rotating member 42 respectively. Preferably, the first rotating speed sensor 60 can detect the direction of rotation of the first rotating member 22, and the second rotating speed sensor 70 can detect the direction of rotation of the second rotating member 42.

The control panel 80 is set on the frame 10 and includes a display module 82, a control module 84, and a starting switch 86. The control module 84 is electrically connected to the first driving module 30, the second driving module 50, the first rotating speed sensor 60, the second rotating speed sensor 70, the display module 82, and the starting switch 86. In this embodiment, the display module 82 is a monitor which is set on the frame 10. The monitor can display the first rotating speed and the second rotating speed for users to clearly know the current rotating speeds. The starting switch 86 can be a physical button for users to operate; the users can activate or close the starting switch 86 by pressing the starting switch 86. When the user activates the starting switch 86, the control module 84 controls at least one of the first driving module 30 and the second driving module 50 according to the first rotating speed and the second rotating speed; when the user closes the starting switch 86, the control module 84 stop controlling the first driving module 30 and the second driving module 50. In practical, the display module 82 can be a touch monitor; the starting switch 86 can also be a virtual key displayed on the touch monitor for users to click. Moreover, the display module 82 is electrically connected to the control module 84, and the starting switch 86 is not limited to the abovementioned physical button.

Figure 5:
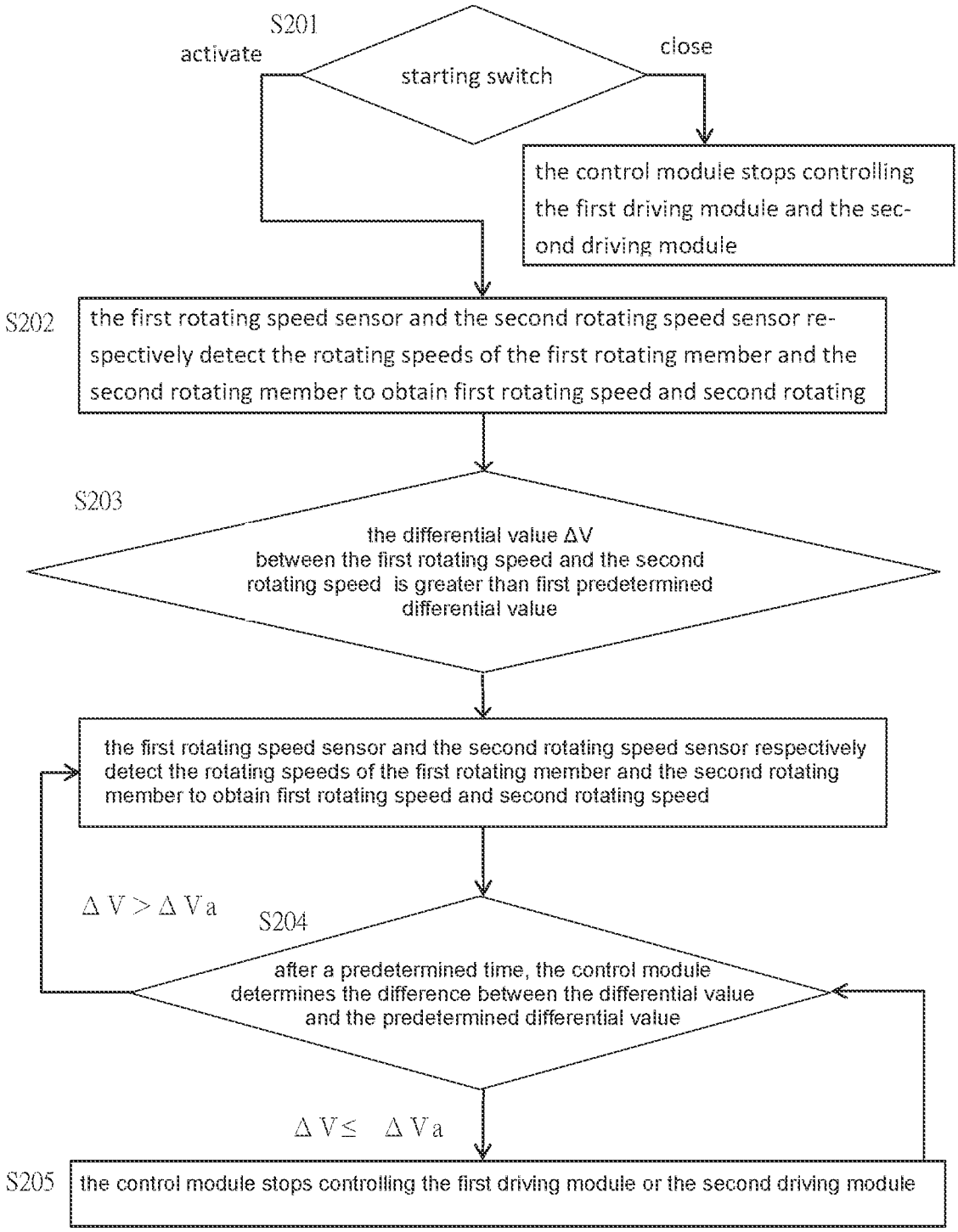
FIG. 5 is a flow chart of the control method for the limbs cooperation exerciser of the first preferred embodiment.

As shown in FIG. 5, a control method for the limbs cooperation exerciser 1 is provided, and is performed by the control module 84. The control method for the limbs cooperation exerciser 1 includes the following steps.

Step S201: a user activates or closes the starting switch 86; if the starting switch 86 is activated, the control module 84 controls at least one of the first driving module 30 and the second driving module 50 according to the first rotating speed and the second rotating speed. If the starting switch 86 is closed, the control module 84 stops controlling the first driving module 30 and the second driving module 50. In other words, when the user needs the limbs cooperation exerciser 1 to provide auxiliary functions, the user has to activate the starting switch 86 so as to make the control module 84 control at least one of the first motor 32 and the second motor 52, which assists the user's upper or lower limbs in performing periodic revolving motions. When the user doesn't need the limbs cooperation exerciser 1 to provide auxiliary functions, the user has to close the starting switch 86 so as to make the control module 84 stops controlling the first motor 32 and the second motor 52. At this time, the user uses his/her own force to control the first operating member 24 and the second operating member 44, and furthermore controls the rotating speeds of the first rotating member 22 and the second rotating member 42 depending on the degree of force exerted by the user.

Step S202: the control module 84 obtains the first rotating speed which is detected by the first rotating speed sensor 60, and obtains the second rotating speed which is detected by the second rotating speed sensor 70. Preferably, step S202 further includes the step of: displaying the first rotating speed and the second rotating speed through the display module 82. Preferably, step S202 further includes the step of: the first rotating speed sensor 60 detects the direction of rotation of the first rotating member 22, and the second rotating speed sensor 70 detects the direction of rotation of the second rotating member 42; the direction of rotation of the first rotating member 22, which is detected by the first rotating speed sensor 60 is a first direction, wherein the first direction is forward or backward; the direction of rotation of the second rotating member 42, which is detected by the second rotating speed sensor 70 is a second direction, wherein the second direction is forward or backward. Additionally, step S202 includes the step of: displaying the first direction and the second direction by the display module 82. For example, when the user uses the upper limbs to drive the first rotating member to rotate 20 revolutions forward per minute, and uses the lower limbs to drive the second rotating member to rotate 15 revolutions backward per minute, the display module 82 shows that the first rotating speed is 20 RPM, the first direction is defined as forward, while the second rotating speed is 15 RPM, and the second direction is defined as backward. The abovementioned forward or backward direction can also be shown on the display module 82 with arrows to indicate the direction or signs such as +/−. In this way, the users can clearly know the current rotating speeds and directions of the first rotating member 22 and the second rotating member 42 so as to adjust the degree of force by themselves.

Step S203: the control module 84 controls at least one of the first driving module 30 and the second driving module 50 according to the first rotating speed and the second rotating speed, so that a differential value ΔV between the detected first rotating speed and the second rotating speed is smaller than or equal to a predetermined differential value ΔVa. Preferably, according to the first direction detected by the first rotating speed sensor 60 and the second direction detected by the second rotating speed sensor 70, the control module 84 controls the first motor 32 of the first driving module 30 to drive the first rotating member 22 to increase the rotating speed along the same first direction, or controls the second motor 52 of the second driving module 50 to drive the second rotating member 42 to increase the rotating speed along the same second direction.

For example, if the predetermined differential value ΔVa is 5 RPM, and the first rotating speed of the first rotating member 22 driven by the user is 20 RPM, and the first direction is forward, and additionally, the second rotating speed of the second rotating member 42 is 10 RPM, and the second direction is backward, and the differential value ΔV between the first rotating speed and the second rotating speed is 10 RPM, the control module 84 would control the second driving module 50 and drive the second rotating member 42 to increase the rotating speed reversely to increase the second rotating speed, so that the differential value ΔV between the first rotating speed and the second rotating speed would be smaller than or equal to the predetermined differential value ΔVa. Such design can assist in improving the user's weaker lower limbs to perform periodic revolving motions, which is close to the revolving speed of the upper limbs. In an embodiment, the control module 84 controls at least one of the first driving module 30 and the second driving module 50 according to the first rotating speed and the second rotating speed to make the differential value ΔV be 0. In other words, the control module 84 controls at least one of the first driving module 30 and the second driving module 50 to drive the first rotating member 22 or the second rotating member 42 to increase the rotating speeds which is first rotating speed or the second rotating speed, so that the first rotating speed is equal to the second rotating speed. In this way, the weaker limbs can be assisted to perform periodic revolving motions that match the revolving speed of the stronger limbs.

Preferably, step S203 further includes the step of: if the differential value ΔV between the first rotating speed and the second rotating speed is greater than a first predetermined differential value, the control module 84 controls at least one of the first driving module 30 and the second driving module 50, which makes the differential value ΔV smaller than or equal to the predetermined differential value ΔVa; if the first rotating speed is smaller than the second rotating speed, the control module 84 controls the first driving module 30 to drive the first rotating member 22 to increase the rotating speed which is the first rotating speed; if the second rotating speed is smaller than the first rotating speed, the control module 84 controls the second driving module 50 to drive the second rotating member 42 to increase the rotating speed which is the second rotating speed. For example, if the first predetermined differential value is 10 RPM, the user would drive the first rotating member 22 to make the first rotating speed be 20 RPM, as well as drive the second rotating member 42 to make the second rotating speed be 5 RPM; in this time, the differential value ΔV is 15 RPM which is greater than the first predetermined differential value, 10 RPM, and the second rotating speed is smaller than the first rotating speed, so the control module 84 controls the second driving module 50 to increase the second rotating speed, making the differential value ΔV between the first rotating speed and the second rotating speed smaller than or equal to the predetermined differential value ΔVa, 5 RPM.

Step S204: after a predetermined time, the control module determines the difference between the differential value ΔV and the predetermined differential value ΔVa, wherein the differential value ΔV is formed between the first rotating speed and the second rotating speed.

Step S205: if the differential value ΔV between the first rotating speed and the second rotating speed is smaller than or equal to the predetermined differential value ΔVa, the control module 84 would stop controlling the first driving module 30 or the second driving module 50, and step S204 would be performed after step S205; if the differential value ΔV between the first rotating speed and the second rotating speed is greater than the predetermined differential value ΔVa, perform step S203. For example, if the predetermined differential value ΔVa is 5 RPM, and the user drives the first rotating member 22 to make the first rotating speed be 20 RPM as well as drives the second rotating member 42 to make the second rotating speed be 10 RPM, the differential value between the first rotating speed and the second rotating speed is 10 RPM. In this time, the control module 84 controls the second driving module 50 and drives the second rotating member 42 to increase the rotating speed which is the second rotating speed, so that the differential value ΔV (10 RPM) between the first rotating speed and the second rotating speed is smaller than or equal to the predetermined differential value ΔVa (5 RPM). After the predetermined time (such as 5 minutes), the control module 84 determines whether to perform step S204 or step S203 according to the difference between the differential value ΔV and the predetermined differential value ΔVa. If the differential value ΔV between the first rotating speed and the second rotating speed is smaller than or equal to the predetermined differential value ΔVa, which means the revolving speeds of the upper and lower limbs of the user are close, perform step S205, and the control module 84 stops controlling the second driving module 50. At this time, the lower limb exercise mechanism 40 returns to the mode that the user uses his/her own force to operate the second operating member 44, and controls the rotating speed of the second rotating member 42 depending on the degree of force exerted by the user. moreover, if the differential value ΔV between the first rotating speed and the second rotating speed is greater than the predetermined differential value ΔVa (5 RPM), e.g., when the revolving speed of the user's upper limbs slows down so that the first rotating speed drops to 10 RPM, the differential value ΔV between the first rotating speed and the second rotating speed is greater than the predetermined differential value ΔVa, 5 RPM, the control module 84 controls the first driving module 30 to increase the first rotating speed, making the differential value ΔV between the first rotating speed and the second rotating speed smaller than or equal to the predetermined differential value ΔVa, 5 RPM so as to assist in improving the user's upper limbs to perform periodic revolving motions, which makes the revolving speed of the upper limbs close to the revolving speed of the lower limbs.

Figure 6:
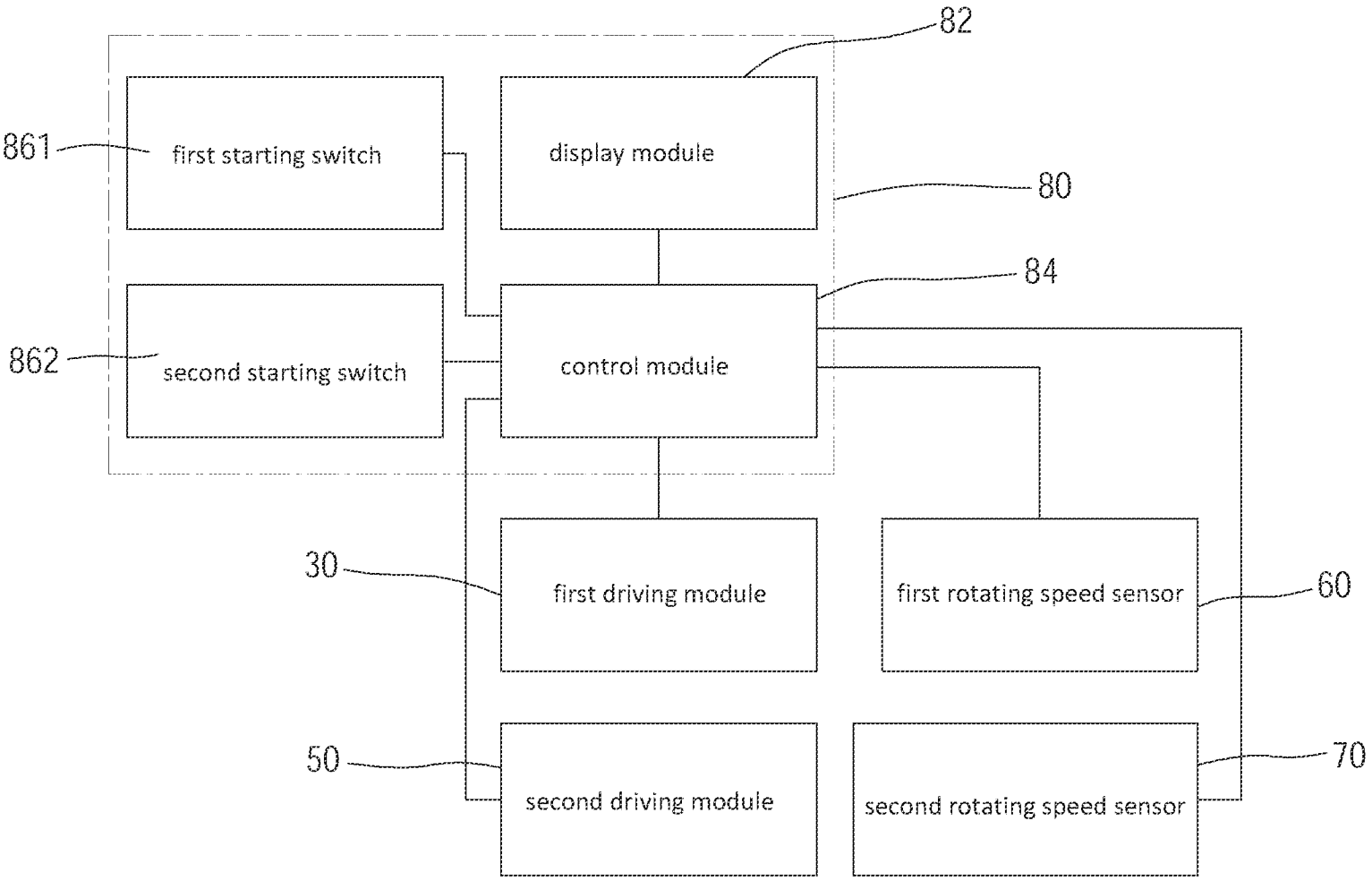
FIG. 6 is a block diagram of the limbs cooperation exerciser of the second preferred embodiment.

FIG. 6 is a block diagram of the limbs cooperation exerciser of the second embodiment of the present invention, which has approximately the same structure as the limbs cooperation exerciser 1 of the first embodiment. The difference is that, the control panel 80 includes a first starting switch 861 and a second starting switch 862, wherein the first starting switch 861 and the second starting switch 862 are electrically connected to the control module 84.

The limbs cooperation exerciser in the second embodiment can also be applied to the control method of the first embodiment. The difference is that, the control module 84 controls the first driving module 30 or the second driving module 50 based on whether the first starting switch 861 and the second starting switch 862 are activated or closed. In detail, when the user activates the first starting switch 861, the control module 84 controls the first driving module 30 according to the first rotating speed and the second rotating speed; when the user activates the second starting switch 862, the control module 84 controls the second driving module 50 according to the first rotating speed and the second rotating speed. When the user closes the first starting switch 861, the control module 84 stops controlling the first driving module 30; when the user closes the second starting switch 862, the control module 84 stops controlling the second driving module 50. The first starting switch 861 and the second starting switch 862 can be physical buttons for users to operate, and can also be virtual keys displayed on the display module 82, which are electrically connected to the control module 84 through the display module 82.

For example, if the user only needs the auxiliary functions for lower limbs of the limbs cooperation exerciser rather than the auxiliary functions for upper limbs, the user can close the first starting switch 861 as well as activate the second starting switch 862, making the control module 84 stop controlling the first driving module 30, i.e., the first motor 32. At this time, the user uses his/her own force to control the first operating member 24, and controls the rotating speed of the first rotating member 22 depending on the degree of force exerted by the user. In addition, the control module 84 can still control the second driving module 50 to make the differential value ΔV between the detected first rotating speed and the second rotating speed be smaller than or equal to the predetermined differential value ΔVa, i.e., the control module 84 can control the second driving module 50 to drive the second rotating member 42 to increase the rotating speed to raise the second rotating speed, and therefore the differential value ΔV between the first rotating speed and the second rotating speed is smaller than or equal to the predetermined differential value ΔVa, which assists the user's lower limbs in performing periodic revolving motions.

The embodiments described above are only preferred embodiments of the present invention. All equivalent structures and methods which employ the concepts disclosed in this specification and the appended claims should fall within the scope of the present invention.

What is claimed is:

1. A limbs cooperation exerciser, comprising:

a frame;

an upper limb exercise mechanism which comprises a first rotating member and a first operating member, wherein the first rotating member is pivotally connected to the frame; the first operating member is connected to the first rotating member, and the first operating member is driven by a first external force to drive the first rotating member to rotate;

a first driving module which is coupled to the first rotating member and is controllable to drive the first rotating member to rotate;

a lower limb exercise mechanism which comprises a second rotating member and a second operating member, wherein the second rotating member is pivotally connected to the frame; position of the second rotating member is lower than the first rotating member; the second operating member is connected to the second rotating member, and the second operating member is driven by a second external force to drive the second rotating member to rotate;

a second driving module which is coupled to the second rotating member and is controllable to drive the second rotating member to rotate;

a first rotating speed sensor which is coupled to the upper limb exercise mechanism for detecting rotating speed of the first rotating member;

a second rotating speed sensor which is coupled to the lower limb exercise mechanism for detecting rotating speed of the second rotating member; and a control module which is electrically connected to the first driving module, the second driving module, the first rotating speed sensor, and the second rotating speed sensor;

the control module obtains a first rotating speed which is detected by the first rotating speed sensor, and obtains a second rotating speed which is detected by the second rotating speed sensor; the control module controls at least one of the first driving module and the second driving module according to the first rotating speed and the second rotating speed, which makes a differential value between the first rotating speed and the second rotating speed be smaller than or equal to a predetermined differential value; wherein if the differential value between the first rotating speed and the second rotating speed is greater than a first predetermined differential value, the control module controls at least one of the first driving module and the second driving module, which makes the differential value be smaller than or equal to the predetermined differential value;

wherein if the first rotating speed is smaller than the second rotating speed, the control module controls the first driving module and drives the first rotating member to increase rotating speed to raise the first rotating speed; if the second rotating speed is smaller than the first rotating speed, the control module controls the second driving module and drives the second rotating member to increase rotating speed to raise the second rotating speed.

2. The limbs cooperation exerciser of claim 1, wherein the differential value is 0.

3. The limbs cooperation exerciser of claim 1, wherein the first operating member is driven by the first external force to drive the first rotating member to rotate forward or backward; the second operating member is driven by the second external force to drive the second rotating member to rotate forward or backward.

4. The limbs cooperation exerciser of claim 3, wherein the first rotating speed sensor detects that rotation direction of the first rotating member is a first direction which is forward or backward; the second rotating speed sensor detects that rotation direction of the second rotating member is a second direction which is forward or backward; according to the first direction detected by the first rotating speed sensor and the second direction detected by the second rotating speed sensor, the control module controls the first driving module to drive the first rotating member to increase rotating speed along the first direction, or alternatively controls the second driving module to drive the second rotating member to increase rotating speed along the second direction.

5. The limbs cooperation exerciser of claim 1, further comprising a display module for displaying the first rotating speed and the second rotating speed.

6. The limbs cooperation exerciser of claim 1, wherein the control module controls at least one of the first driving module and the second driving module; after a predetermined time, if the differential value between the first rotating speed and the second rotating speed be smaller than or equal to the predetermined differential value, the control module stops controlling the first driving module or the second driving module.

7. The limbs cooperation exerciser of claim 1, further comprising a starting switch which is electrically connected to the control module; when the starting switch is activated, the control module controls at least one of the first driving module and the second driving module according to the first rotating speed and the second rotating speed; when the starting switch is closed, the control module stops controlling the first driving module and the second driving module.

8. The limbs cooperation exerciser of claim 1, further comprising a first starting switch and a second starting switch, wherein the first starting switch and the second starting switch are electrically connected to the control module; when the first starting switch is activated, the control module controls the first driving module according to the first rotating speed and the second rotating speed; when the second starting switch is activated, the control module controls the second driving module according to the first rotating speed and the second rotating speed; when the first starting switch is closed, the control module stops controlling the first driving module; when the second starting switch is closed, the control module stops controlling the second driving module.

9. A control method for a limbs cooperation exerciser, wherein the limbs cooperation exerciser comprises an upper limb exercise mechanism, a first driving module, a lower limb exercise mechanism, a second driving module, a first rotating speed sensor, a second rotating speed sensor, and a control module; the upper limb exercise mechanism comprises a first rotating member and a first operating member, wherein the first operating member is connected to the first rotating member, and the first operating member is driven by a first external force to drive the first rotating member to rotate; the lower limb exercise mechanism comprises a second rotating member and a second operating member, wherein the second operating member is connected to the second rotating member, and the second operating member is driven by a second external force to drive the second rotating member to rotate; the first rotating speed sensor is provided for detecting rotating speed of the first rotating member, and the second rotating speed sensor is provided for detecting rotating speed of the second rotating member; the control method for the limbs cooperation exerciser is executed by the control module and comprises the steps of:

detecting rotating speeds of the first rotating member and the second rotating member through the first rotating speed sensor and the second rotating member respectively so as to obtain a first rotating speed and a second rotating speed;

controlling at least one of the first driving module and the second driving module according to the first rotating speed and the second rotating speed, making a differential value between the detected first rotating speed and the second rotating speed be smaller than or equal to a predetermined differential value, wherein if the differential value between the first rotating speed and the second rotating speed is greater than a first predetermined differential value, the control module controls at least one of the first driving module and the second driving module, which makes the differential value be smaller than or equal to the predetermined differential value;

wherein if the first rotating speed is smaller than the second rotating speed, the control module controls the first driving module and drives the first rotating member to increase rotating speed to raise the first rotating speed; if the second rotating speed is smaller than the first rotating speed, the control module controls the second driving module and drives the second rotating member to increase rotating speed to raise the second rotating speed.

10. The control method of claim 9, wherein the control module controls at least one of the first driving module and the second driving module according to the first rotating speed and the second rotating speed, making the differential value be 0.

11. The control method of claim 9, wherein the first operating member is driven by the first external force to drive the first rotating member to rotate forward or backward; the second operating member is driven by the second external force to drive the second rotating member to rotate forward or backward; the first rotating speed sensor detects that rotation direction of the first rotating member is a first direction which is forward or backward; the second rotating speed sensor detects that rotation direction of the second rotating member is a second direction which is forward or backward; according to the first direction detected by the first rotating speed sensor and the second direction detected by the second rotating speed sensor, the control module controls the first driving module to drive the first rotating member to increase rotating speed along the first direction, or alternatively controls the second driving module to drive the second rotating member to increase rotating speed along the second direction.

12. The control method of claim 9, further comprising the step of:

displaying the first rotating speed and the second rotating speed through a display module.

13. The control method of claim 9, wherein the control module controls at least one of the first driving module and the second driving module; after a predetermined time, if the differential value between the first rotating speed and the second rotating speed be smaller than or equal to the predetermined differential value, the control module stops controlling the first driving module or the second driving module.

14. The control method of claim 9, further comprising the steps:

when a starting switch is activated, the control module controls at least one of the first driving module and the second driving module according to the first rotating speed and the second rotating speed; when the starting switch is closed, the control module stops controlling the first driving module and the second driving module.

15. The control method of claim 9, further comprising the steps:

when a first starting switch is activated, the control module controls the first driving module according to the first rotating speed and the second rotating speed; when a second starting switch is activated, the control module controls the second driving module according to the first rotating speed and the second rotating speed; when the first starting switch is closed, the control module stops controlling the first driving module; when the second starting switch is closed, the control module stops controlling the second driving module.

* * * * *